United States Patent [19]

Binnewies

[11] Patent Number: 5,060,160

[45] Date of Patent: Oct. 22, 1991

[54] METHOD FOR CALCULATING THE QUANTITY OF FUEL TO BE SUPPLIED TO AN INTERNAL COMBUSTION ENGINE

[75] Inventor: Ludwig Binnewies, Lappersdorf, Fed. Rep. of Germany

[73] Assignee: Siemens Aktiengesellschaft, Munich, Fed. Rep. of Germany

[21] Appl. No.: 446,929

[22] Filed: Dec. 6, 1989

[30] Foreign Application Priority Data

Dec. 7, 1988 [EP] European Pat. Off. ..... 88120463.0

[51] Int. Cl.[5] ..... F02D 41/26

[52] U.S. Cl. ..... 364/442; 364/431.07; 123/488; 123/494

[58] Field of Search ..... 364/442, 431.05, 431.07; 123/480, 488, 494

[56] References Cited

U.S. PATENT DOCUMENTS

| | | | |
|---|---|---|---|
| 3,846,625 | 11/1974 | Satayama | 364/723 |
| 4,034,722 | 7/1977 | Miyakawa | 123/32 |
| 4,424,568 | 1/1984 | Nishimura et al. | 364/431.07 |
| 4,590,563 | 5/1986 | Matsumura et al. | 364/431.05 |
| 4,604,703 | 8/1986 | Hasegawa | 364/431.07 |
| 4,753,206 | 6/1988 | Inoue et al. | 123/480 |
| 4,823,755 | 4/1989 | Hirose et al. | 123/480 |
| 4,919,100 | 4/1990 | Nakamura | 123/488 |
| 4,960,097 | 10/1990 | Tachibana et al. | 123/494 |

FOREIGN PATENT DOCUMENTS

| | | |
|---|---|---|
| 3802211 | 4/1988 | Fed. Rep. of Germany . |
| 8305385 | 3/1983 | France . |
| 2046950A | 11/1980 | United Kingdom . |

*Primary Examiner*—Gary Chin

*Attorney, Agent, or Firm*—Hill, Van Santen, Steadman & Simpson

[57] ABSTRACT

In a method for calculating the quantity of fuel to be supplied to an internal combustion engine during a dynamic transitional mode, the quantity of fuel is calculated from a corrected intake pressure value pkorr and from the speed n. The corrected intake pressure values pkorr derive from a measured intake pressure value pm taking into consideration the ambient pressure, the ambient temperature, and the time delays between the measured intake pressure pm and the intake pressure actually present in the intake pipe during the dynamic transitional mode. The method guarantees an extremely exact metering of the fuel quantity during the dynamic transitional mode.

8 Claims, 1 Drawing Sheet

METHOD FOR CALCULATING THE QUANTITY OF FUEL TO BE SUPPLIED TO AN INTERNAL COMBUSTION ENGINE

BACKGROUND OF THE INVENTION

The invention is directed to a method for calculating the quantity of fuel to be supplied to an internal combustion engine during a dynamic transitional mode, and wherein at every cycle of the internal combustion engine, an intake pressure pm, a speed n, an opening angle $\alpha$ of a throttle valve of the engine, and an intake air temperature TAL are measured.

U.S. Pat. No. 4,424,568, incorporated herein by reference, discloses such a method. The measured value of the intake pressure is corrected by a computer factor during dynamic transitional events such as acceleration or deceleration. This computer factor takes into consideration that the intake pressure has changed in comparison to the measured value during the time required for the calculation of the quantity of fuel to be supplied. The quantities of fuel calculated in this fashion for the transitional mode of the internal combustion engine yield an improved transitional behavior.

SUMMARY OF THE INVENTION

An object of the invention is to further improve the transitional behavior by correcting the falsifying influence of further factors on the measured intake pressure.

According to the invention, at least first, second, third, and fourth supporting characteristics fields are created each containing supporting values for intake pressure of the engine dependent on speed n of the engine and on an opening angle $\alpha$ of the throttle valve of the engine. The first field is valid for a first ambient pressure and a first ambient temperature, the second field is valid for the first ambient pressure and a second ambient temperature, the third field is valid for a second ambient pressure and the first ambient temperature, and the fourth field is valid for the second ambient pressure and the second ambient temperature. At every cycle of the internal combustion engine an intake pressure pm of the engine, a speed n of the engine, an opening angle of the throttle valve of the engine, and an intake air temperature TAL of the engine are measured. At every cycle of the internal combustion engine the following steps are also performed:

- a first division ratio is calculated that characterizes intake air temperature TAL relative to the first and second ambient temperatures of the first and second fields valid for the first ambient pressure;
- with currently identified values for the speed n and the opening angle $\alpha$, a respective supporting value psa, psb, psc, or psd is obtained from the respective first, second, third, and fourth fields;
- a supporting maximum value psH is calculated from the first division ratio and from the supporting values psa and psb for the first ambient pressure;
- a supporting minimum value psL is calculated from the first division ratio and from the supporting values psc and psd for the second ambient pressure; and
- a second division ratio is calculated that characterizes measured intake pressure pm relative to the supporting maximum value psH and the supporting minimum value psL. A compensated intake pressure pk is calculated from the second division ratio and from the respective current supporting maximum value psH and supporting minimum value psL. Using the compensated intake pressure pk, the respective currently measured intake pressure pm is corrected to form a dynamic intake pressure pdyn according to the relationship $$pdyn = pm + \frac{pk - pm}{\tau},$$

whereby $\tau$ is a time constant that takes dead times of air masses in an intake train of the engine into consideration. A corrected intake pressure pkorr is calculated from the dynamic intake pressure pdyn plus a computer factor RF that takes a delay time tv caused by calculated operations of the computer into consideration. The quantity of fuel is defined by use of the corrected intake pressure value pkorr together with the speed n.

The invention is based on the consideration that the influences of various ambient pressures and temperatures must first be compensated for an exact correction of the measured intake pressure. When one proceeds on the basis of a defined throttle valve angle and on the basis of a defined RPM in stationary operation, then respectively different intake pressures result for different ambient pressures and temperatures.

According to the invention, the supporting characteristics fields are employed in which the values for the intake pressure are deposited for a respectively defined ambient pressure and defined ambient temperature dependent on the throttle valve angle and the RPM. At least four such supporting characteristics fields are employed. Two thereof are valid for an identical, first ambient pressure, but for two different ambient temperatures. The other two are valid for an identical, second ambient pressure and the two different ambient temperatures.

These supporting characteristics fields are experimentally calculated and are deposited in the computer unit that carries out the pressure correction.

Two supporting values for the pressure calculated according to the current values for the degree of opening of the throttle valve and for the RPM at every cycle of the internal combustion engine are read out from the two characteristics fields for the identical, first ambient pressure. These two supporting values are respectively valid for that ambient temperature for which the respective supporting characteristics field was calculated. A linear approximation is carried out in order to acquire a pressure value therefrom for the ambient temperature now prevailing. It is thus assumed that the prevailing ambient temperature corresponds to a temperature of the intake air that is acquired via a temperature sensor.

A supporting division ratio is calculated that places the temperature value of the intake air in relationship to the values of the two ambient temperatures for which the two supporting characteristics fields are valid. With this supporting division ratio, a supporting maximum value is then identified from the two supporting values for the pressure. Relative to the two supporting values, this supporting maximum value thus behaves like the temperature value of the intake air relative to the two ambient temperatures.

The supporting maximum value thus represents a temperature-compensated value for the intake pressure that is valid for the defined, first ambient pressure.

The same method is carried out with the other two characteristics fields that are valid for the same, second ambient pressure and for the two ambient temperatures. A supporting minimum value then correspondingly results which represents a temperature-compensated value for the intake pressure valid for the second ambient pressure.

More supporting characteristics fields can also be employed instead of the two supporting characteristics fields employed for the two ambient pressures. A supporting maximum value or a supporting minimum value is calculated from the two respective supporting values in the temperature compensation, with linear relationships being assumed. This is necessarily an approximation that can be improved by employing further supporting characteristics fields and, thus, a section-by-section linearization. Advantageously, the supporting division ratio is then calculated relative to the two supporting characteristics fields between the ambient temperatures of which the intake air temperature lies, and which come closest to the intake air temperature.

Further supporting characteristics fields can be employed in a similar way for further ambient pressures. The respectively two supporting values for the calculation of the supporting maximum value or supporting minimum value are then preferably taken from those supporting characteristics fields between the ambient pressures of which the measured value of the intake pressure lies, and that come closest thereto.

The value of the intake pressure measured in the stationary operation of the internal combustion engine now lies somewhere between the supporting maximum value and the supporting minimum value. A division ratio is calculated for this position that places the size of this measured intake pressure in relationship to the supporting maximum value and in relationship to the supporting minimum value.

When the internal combustion engine is then accelerated or decelerated from the stationary operation, then the values for the opening degree of the throttle valve and/or for the RPM correspondingly change. A new supporting maximum value and supporting minimum value are then again calculated at every cycle with these new values from the four supporting characteristics fields. Since the measured values for the intake pressure are too imprecise in the dynamic operation of the internal combustion engine that is now present, they are corrected with a compensated intake pressure valid for the new operating status that is calculated from the new values for the supporting maximum value, from the supporting minimum value, and from the division ratio. This compensated intake pressure in dynamic operation behaves, relative to the new supporting maximum value and supporting minimum value, like the measured intake pressure in the stationary operation behaves relative to the supporting maximum value and supporting minimum value valid for such operation.

Conclusions based on the static operation are then made about the dynamic operation with the assumption that the division ratio for the respectively valid intake pressure remains the same in dynamic operation in comparison to stationary operation.

The measured intake pressure is now corrected to form a dynamic intake pressure with the assistance of the compensated intake pressure wherein the difference from the compensated intake pressure and the measured intake pressure divided by a time constant is added thereto. This time constant takes into consideration the time lag between the measured intake pressure and the dynamic intake pressure actually present in the intake pipe.

Finally, a computer factor is also added to the dynamic intake pressure value. The computer factor takes the calculating time for the execution of the corrective calculation into consideration. A corrected pressure value calculated in this way is then the value that, together with the RPM, defines the respective quantity of fuel to be supplied.

DESCRIPTION OF THE PREFERRED EMBODIMENTS

Figure 1:
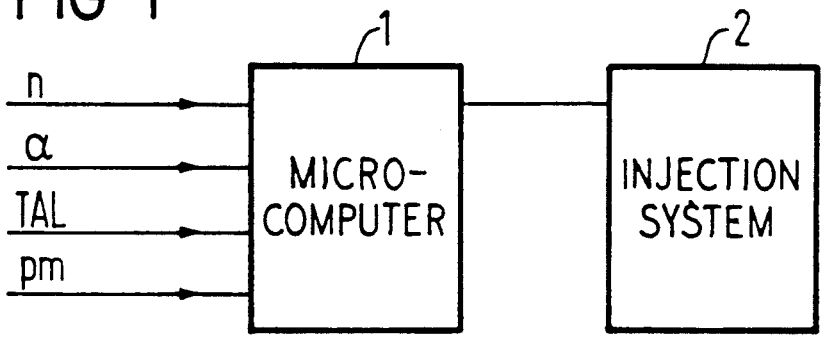
FIG. 1 is a greatly simplified block circuit diagram of a means for the implementation of the method of the invention.

FIG. 1 shows a block circuit diagram of a means that serves the purpose of supplying an internal combustion engine with the quantity of fuel respectively required. Reference numeral 1 references a microcomputer to which the values for a speed n, an opening angle $\alpha$ of the throttle valve, an intake air temperature TAL, and a measured intake pressure pm are supplied as input signals. The microcomputer 1 calculates from these input parameters the necessary quantity of fuel at every cycle of the internal combustion engine through use of various characteristics fields. It then forwards an appropriate instruction to an injection system 2 that has all components needed for operation such as a metering means, injection valves, etc.

Figure 2:
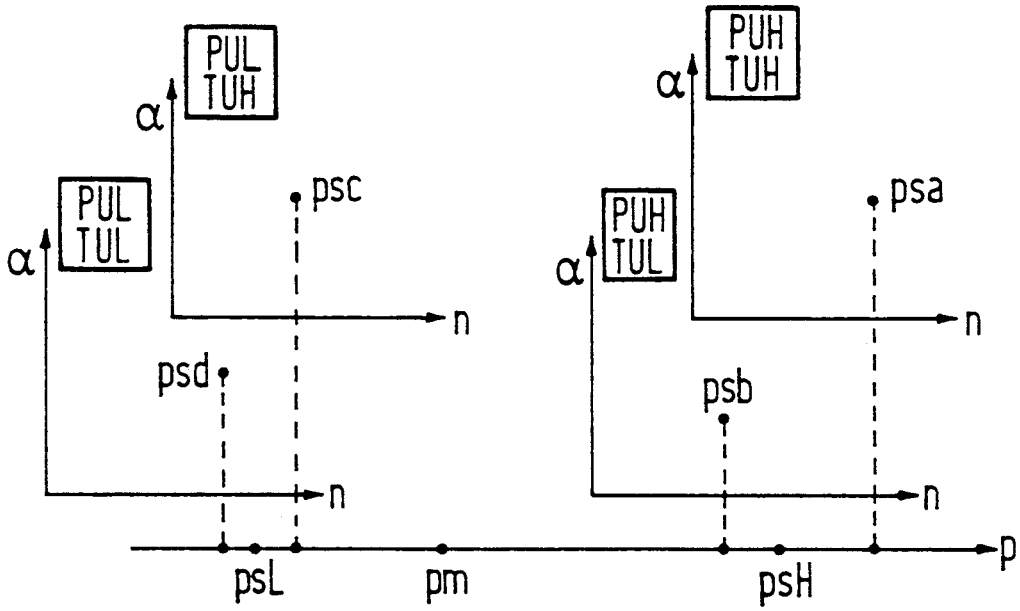
FIG. 2 shows four supporting characteristics fields on which the corrective calculation of the invention is based.

FIG. 2 indicates four supporting characteristics fields that are deposited in the microcomputer 1. These supporting characteristics fields form the basis for the calculation of a corrected intake pressure value pkorr during a dynamic transitional operation based on a measured intake pressure value pm during a stationary operation of the internal combustion engine.

The supporting characteristics fields respectively contain pressure values dependent on the opening angle $\alpha$ of the throttle valve and on the speed n of the internal combustion engine. They are experimentally identified and are valid for various ambient conditions. The two supporting characteristics fields shown at the right are valid for a high ambient pressure PUH of 1040 mbar, with the one characteristic field being for a high ambient temperature TUH of $+50°$ C. and the other for a low ambient temperature TUL of $-20°$ C. Correspondingly, the two supporting characteristics fields shown at the left are valid for a low ambient pressure PUL of 970 mbar, with the one characteristic field being again valid for the high ambient temperature TUH and the other characteristic field for the low ambient temperature TUL.

The supporting characteristics fields are deposited in the microcomputer 1 as memory areas, whereby the values for $\alpha$ and n respectively represent the addresses for the memory cells having the corresponding pressure value.

Let a stationary operating condition of the internal combustion engine having an opening angle $\alpha 0$ of the throttle valve and a speed n0 now be assumed. A supporting value psa through psd for the pressure is read out of each of the supporting characteristics fields corresponding to these values. In order to illustrate the following calculating procedure, these four supporting values are transferred onto a straight line of pressures in FIG. 2, whereby the values increase from left to right.

A supporting division ratio λs that characterizes the value of the temperature TAL of the intake air relative to the high ambient temperature TUH and low ambient temperature TUL is calculated according to the equation $$\lambda s = \frac{TUH - TAL}{TUH - TUL}$$

In order to calculate temperature-compensated supporting maximum values psH from the two supporting values psa and psb valid for the high ambient pressure PUH, the supporting division ratio λs is employed. Accordingly, $$\lambda s = \frac{psa - psH}{psa - psb}$$

and, thus $$psH = psa - \lambda s \times (psa - psb).$$

A supporting minimum value psL is calculated from $$psL - psc - \lambda s \times (psc - psd)$$

in the same way for the two supporting values psc and psd valid for the low ambient pressure PUL. The calculated values for this supporting maximum value psH and supporting minimum value psL are likewise entered on the straightline for pressures in FIG. 2. The measured intake pressure values pm are likewise entered therein. A division ratio λ for this measured intake pressure pm relative to the supporting maximum value psH and supporting minimum value psL then is derived as follows:

$$\lambda = \frac{psH - pm}{psH - psL}$$

All of these values calculated up to now remain the same as long as the stationary operating condition (α0, n0) continues to exist. Let it now be assumed that, proceeding from this stationary operating condition, the internal combustion engine is accelerated by opening the throttle valve from an opening angle α0 to an opening angle α1.

During every cycle, the above-described method up to the calculation of the respectively new supporting maximum value psH and supporting minimum value psL is then carried out for the respective, currently acquired values of the opening angle α and of the speed n.

A compensated intake pressure value pk then results with the division ratio λ calculated during the stationary operation. Accordingly, $$\lambda = \frac{psH1 - pk}{psH1 - psL1}$$

and, thus, $$pk = psH1 = \lambda \times (psH1 - psL1)$$

are valid. This compensated intake pressure pk now serves the purpose of correcting the values of the measured intake pressure pm during the dynamic transitional mode. A dynamic intake pressure pdyn derives from the relationship $$pdyn = pm + \frac{pk - pm}{\tau}.$$

τ is an experimentally identified time constant that takes the dead times of the air masses in the intake train into consideration. It thus considers the time delay between the measured intake pressures pm and the dynamic intake pressure pdyn actually present in the intake pipe.

Figure 3:
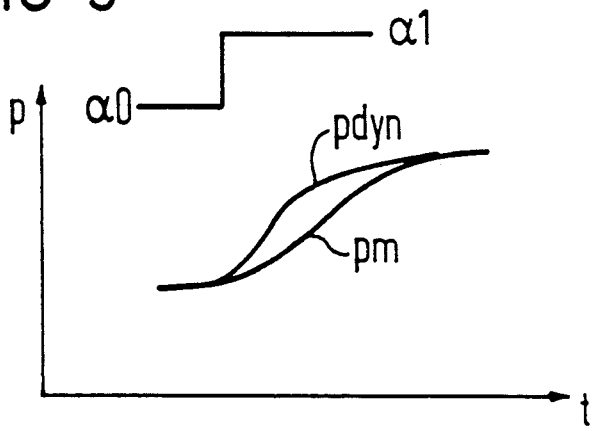
FIG. 3 is a pressure-time diagram for explaining the time delay of the pressure values during a dynamic operation.

The different curves of the measured intake pressure pm and the dynamic intake pressure pdyn actually present in the intake pipe during the dynamic transitional mode due to the opening of the throttle valve from α0 to α1 are shown in the pressure-time diagram in FIG. 3.

For the correction, conclusions are thus made about the dynamic operation based on the static operation, wherein it is assumed that the division ratio calculated in the static operation is valid for this compensated intake pressure in the dynamic operation.

Finally, this dynamic intake pressure pdyn must also be corrected by a computer factor that takes the calculating times of the microcomputer 1 into consideration. This computer factor RF derives from a pressure rise gradient multiplied by the delay time tv of the microcomputer 1. Thus, $$RF = (pdyn_{neu} - pdyn_{alt}) \times tv.$$

A corrected intake pressure value pkorr is then calculated from $$pkorr = pdyn_{neu} + RF.$$

This corrected intake pressure value pkorr is then that value which, together with the speed value n, defines the quantity of fuel to be injected at every cycle.

The above-described method is to be analogously employed for all dynamic transitional events, regardless of whether the internal combustion engine is being accelerated or decelerated, for example. In this latter instance, the pressure rise gradient then corresponds to a pressure decrease gradient.

Although various minor changes and modifications might be proposed by those skilled in the art, it will be understood that I wish to include within the claims of the patent warranted hereon all such changes and modifications as reasonably come within my contribution to the art.

I claim as my invention:

1. A method for calculating a quantity of fuel to be supplied to an internal combustion engine during a dynamic transitional mode, comprising the steps of:

a) creating at least first, second, third, and fourth supporting characteristics fields each containing supporting values for intake pressure of the engine dependent on speed n of the engine and on an opening angle α of a throttle valve of the engine, the first field being valid for a first ambient pressure and a first ambient temperature, the second field being valid for the first ambient pressure and a second ambient temperature, the third field being valid for a second ambient pressure and the first ambient temperature, and the fourth field being valid for the second ambient pressure and the second ambient temperature;

b) at every cycle of the internal combustion engine measuring an intake pressure pm of the engine, a speed n of the engine, an opening angle $\alpha$ of the throttle valve of the engine, and an intake air temperature TAL;

c) at every cycle of the internal combustion engine
(1) calculating a first division ratio that characterizes the intake air temperature TAL relative to said first and second ambient temperatures of said first and second fields valid for said first ambient pressure,
(2) with currently identified values for the speed n and the opening angle $\alpha$, obtaining a respective supporting value psa, psb, psc, or psd from the respective first, second, third, and fourth fields,
(3) calculating a supporting maximum value psH from said first division ratio and from said supporting values psa and psb for the first ambient pressure,
(4) calculating a supporting minimum value psL from said first division ratio and from the supporting values psc and psd for the second ambient pressure, and
(5) calculating a second division ratio that characterizes the measured intake pressure pm relative to the supporting maximum value psH and the supporting minimum value psL;

d) calculating a compensated intake pressure pk from said second division ratio and from the respective current supporting maximum value psH and supporting minimum value psL;

e) using the compensated intake pressure pk to correct the respective currently measured intake pressure pm to form a dynamic intake pressure pdyn according to the relationship $$pdyn = pm + \frac{pk - pm}{\tau}$$

wherein $\tau$ is a time constant that takes dead times of air masses in an intake train of the engine into consideration;

f) calculating a corrected intake pressure pkorr using said dynamic intake pressure pdyn plus correction factor RF that takes a delay time tv caused by said calculation; and g) defining the quantity of fuel by use of said corrected intake pressure value pkorr together with the speed n and supplying said defined quantity of fuel to said internal combustion engine.

2. A method according to claim 1 wherein for step c) (1), the first division ratio is calculated by use of two ambient temperatures between which the intake air temperature TAL lies and which come closest to the intake air temperature TAL.

3. A method according to claim 1 wherein additional characteristics fields for additional ambient pressures and temperatures are provided, and for step c) (5) the second division ratio is calculated by use of two ambient pressures between which the measured intake pressure pm lies and that come closest to the measured intake pressure pm.

4. A method according to claim 1 wherein the first ambient pressure is a relatively high pressure PUH, the first ambient temperature is a relatively high temperature TUH, the second ambient pressure is a relatively low pressure PUL, and the second ambient temperature is a relatively low ambient temperature TUL.

5. A method according to claim 1 wherein said correction factor RF is calculated from a pressure rise gradient $pdyn_{neu} - pdyn_{alt}$ multiplied by said delay time tv, wherein $pdyn_{neu}$ is a currently calculated pdyn value and $pdyn_{alt}$ is a previously calculated pdyn value.

6. A method for calculating a quantity of fuel to be supplied to an internal combustion engine during a dynamic transitional mode, comprising the steps of:

a) creating at least first, second, third, and fourth supporting characteristics fields each containing supporting values for intake pressure of the engine dependent on speed n of the engine and on an opening angle $\alpha$ of a throttle valve of the engine, the first field being valid for a first ambient pressure and a first ambient temperature, the second field being valid for the first ambient pressure and a second ambient temperature, the third field being valid for a second ambient pressure and the first ambient temperature, and the fourth field being valid for the second ambient pressure and the second ambient temperature;

b) at given times during operation of the internal combustion engine measuring an intake pressure pm of the engine, a speed n of the engine, an opening angle $\alpha$ of the throttle valve of the engine, and an intake air temperature TAL;

c) calculating a first division ratio using the intake air temperature TAL and said first and second ambient temperatures;

d) with currently identified values for the speed n and the opening angle $\alpha$, obtaining a respective supporting value psa, psb, psc, or psd from the respective first, second, third, and fourth fields;

e) calculating a supporting maximum value psH from said first division ratio and form said supporting values psa and psb;

f) calculating a supporting minimum value psL from said first division ratio and from the supporting values psc and psd;

g) calculating a second division ratio using the measured intake pressure pm and the supporting maximum value psH and the supporting minimum value psL;

h) calculating a compensated intake pressure pk from said second division ratio and from the respective current supporting maximum value psH and supporting minimum value psL;

i) using the compensated intake pressure pk to correct the respective currently measured intake pressure pm to form a dynamic intake pressure pdyn;

j) calculating a corrected intake pressure pkorr from said dynamic intake pressure pdyn plus a correction factor; and k) defining the quantity of fuel by use of said corrected intake pressure value pkorr together with the speed n and supplying said defined quantity of fuel to said internal combustion engine.

7. A method according to claim 6 wherein said first division ratio is calculated according to the equation $$\frac{TUH - TAL}{TUH - TUL}$$

where TUH and TUL are said first and second ambient temperatures.

8. A method according to claim 6 wherein said second division ratio is calculated according to the equation $$\frac{psH - pm}{psH - psL}$$

where psH and psL are the supporting maximum and minimum values.

* * * * *